United States Patent [19]

Butzen et al.

[11] Patent Number: 4,879,847

[45] Date of Patent: Nov. 14, 1989

[54] COVER FOR PNEUMATIC TOOL

[75] Inventors: James K. Butzen, Grayslake, Ill.; Kenneth C. Happ, Silver Lake; Robert D. Giese, Kenosha, both of Wis.

[73] Assignee: Snap-on Tools Corporation, Kenosha, Wis.

[21] Appl. No.: 322,360

[22] Filed: Mar. 13, 1989

[51] Int. Cl.[4] ..... B24B 23/00

[52] U.S. Cl. ..... 51/170 R; 181/202; 181/207; 181/230; 173/162.2

[58] Field of Search ..... 51/170 R, 170 T, 170 MT; 181/202, 207, 230; 173/162.2, DIG. 2

[56] References Cited

U.S. PATENT DOCUMENTS 2,334,172 11/1943 Champayne ..... 51/170 MT
4,303,131 12/1981 Clark .
4,303,133 12/1981 Godolphin .
4,407,390 10/1983 LeBlanc, Jr. .
4,467,565 8/1984 Wallace et al. .
4,558,763 12/1985 Montabert .
4,660,329 4/1987 Hutchins .

*Primary Examiner*—Roscoe V. Parker
*Attorney, Agent, or Firm*—Emrich & Dithmar

[57] ABSTRACT

A cover for use with a motor and handle extending from the motor comprising, a soft, resilient, fairly rigid, thermoplastic elastomeric material of one-piece construction. The cover has a first body portion having a sidewall and a dome extending from the sidewall defining a cavity to receive the motor, with the dome being spaced from the motor to define a chamber between said dome and motor which serves as a muffler to reduce noise. The cover has a hollow second body portion extending from the first body portion and having a bore to receive the handle.

24 Claims, 2 Drawing Sheets

COVER FOR PNEUMATIC TOOL

BACKGROUND OF THE INVENTION

This application relates to covers for pneumatic tools. In the past, covers have been provided for tools which required several pieces, and are difficult to assemble. It was necessary to polish or paint the exposed portions of the cover to provide the desired appearance of the tool. It is desirable to improve numerous characteristics of such covers for tools which have previously been found deficient.

SUMMARY OF THE INVENTION

It is an object of the present invention to provide a cover for use with a pneumatic tool in which the cover has a simplified construction and reduced cost, and may be incorporated into the pneumatic tool in a simplified manner.

In summary, there is provided a cover for use with a pneumatic tool having a motor and handle extending from the motor and composed of a soft, resilient, fairly rigid, thermoplastic elastomeric material of one-piece construction, the cover comprising a first body portion including a sidewall and a dome extending from the sidewall defining a cavity to receive the motor, the dome being spaced from the motor to define a chamber between the dome and motor which serves as a muffler to reduce noise, a hollow second body portion extending from the first body portion and having a bore to receive the handle, the cover providing a comfortable grip and insulating the hands of the user during use of the device, the cover protecting the motor and handle from damage if dropped, and dampening vibration of the motor and handle, the cover sufficiently shielding the motor to prevent injury to the user, the cover has an external surface which is aesthetically pleasing without additional cosmetic operations to the external surface.

The invention consists of certain novel features and a combination of parts hereafter fully described, illustrated in the accompanying drawings, and particularly pointed out in the appended claims, it being understood that various changes in the details may be made without departing from the true spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
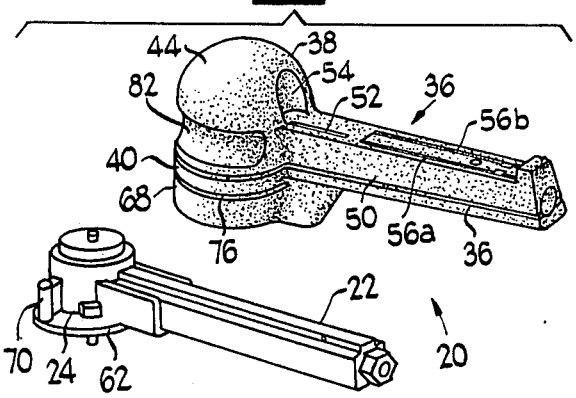
FIG. 1 is an exploded perspective view of a pneumatic tool in the form of a sander which includes a cover of the present invention.
Figure 2:
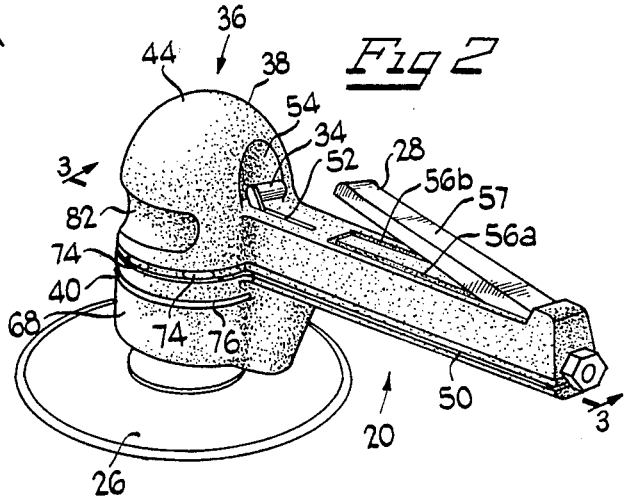
FIG. 2 is a perspective view of the sander of FIG. 1.
Figure 3:
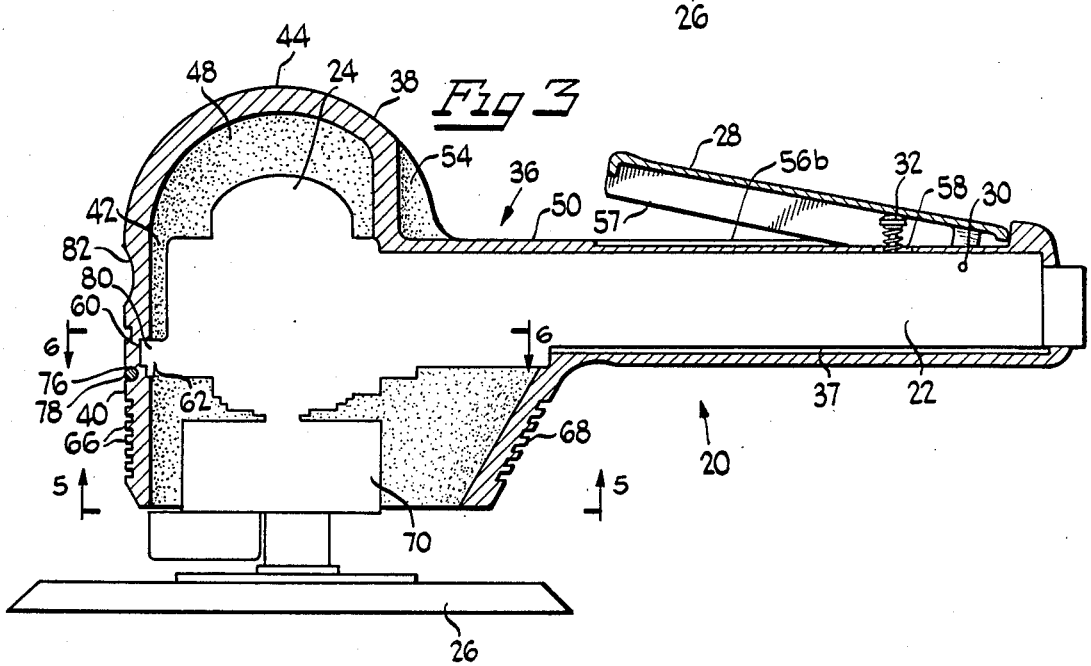
FIG. 3 is an elevational view, taken partly in section, along the 3—3 of FIG. 2.

Referring now to FIGS. 1–3, there is shown a pneumatic tool generally designated 20 in the form of a sander having an elongated handle 22 extending from an air-operated motor 24, with the air passing through the handle 22 to the motor 24 for operation of the motor 24 in driving a pad 26 which retains a sanding sheet for use in sanding a suitable object. In use, the pad 26 is rotatably driven by air which passes through the handle 22 and drives the motor 24 for rotating the pad 26 during use of the tool 20. The tool 20 has a paddle 28 pivotally connected to the handle 22 by a pin 30, and which is utilized to move a valve pin 32 to operate a valve assembly (not shown) in the handle 22 for controlling the passage of air to the motor 24 through the handle 22. The tool 20 has a lever 34 pivotally connected to the handle 12 for use in regulating speed of the tool 20.

The tool 20 has a cover generally designated 36 of the present invention which is injection molded of a thermoplastic elastomeric rubber material, and is of one-piece construction, with the cover 36 surrounding the motor 24 and the handle 22 when the tool is assembled. The thermoplastic, elastomeric material of the cover 36 is of a soft, resilient and fairly rigid construction. The cover 36 comprises a first body portion 38 having an annular sidewall 40 and a convex dome 44 extending from the sidewall 40 defining a cavity 42 to receive the motor 24. As shown, the motor 24 of the assembled tool 20 is spaced from the dome 44 to define a chamber 48 between the dome 44 and motor 24, with combination of the resilience of the dome 44 and chamber 48 serving as a muffler to reduce noise during use of the tool 20. The convex dome 44 is shaped to conveniently fit the palm of the user's hand during use of the tool 20. The cover 36 also has a hollow second body portion 50 extending from the first body portion 38 and having a bore 37 to receive the handle 22.

Figure 4:
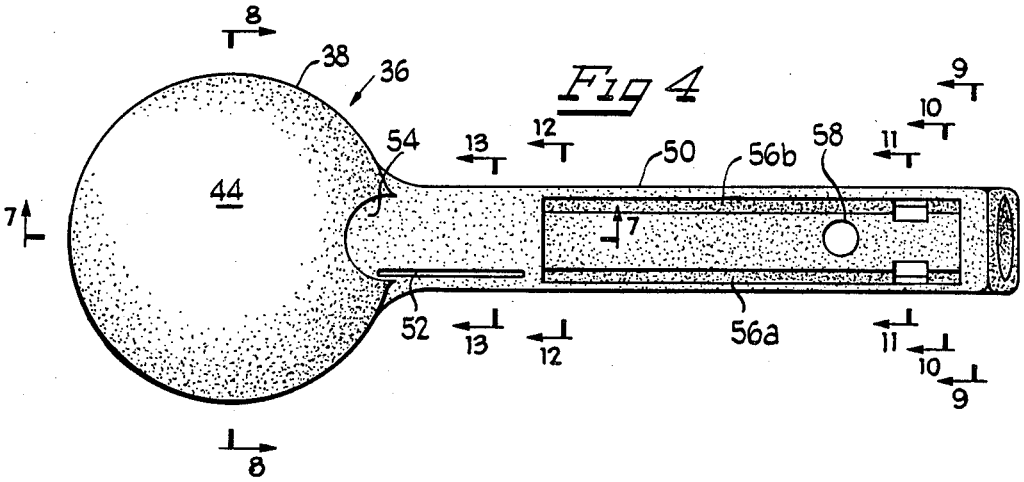
FIG. 4 is an upper plan view of the cover of the present invention.
Figure 5:
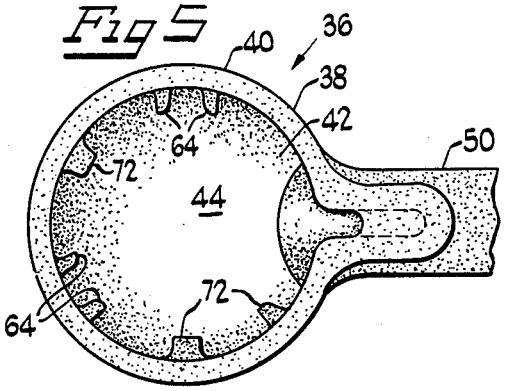
FIG. 5 is a fragmentary lower plan view of the cover taken along 5—5 of FIG. 3.
Figure 7:
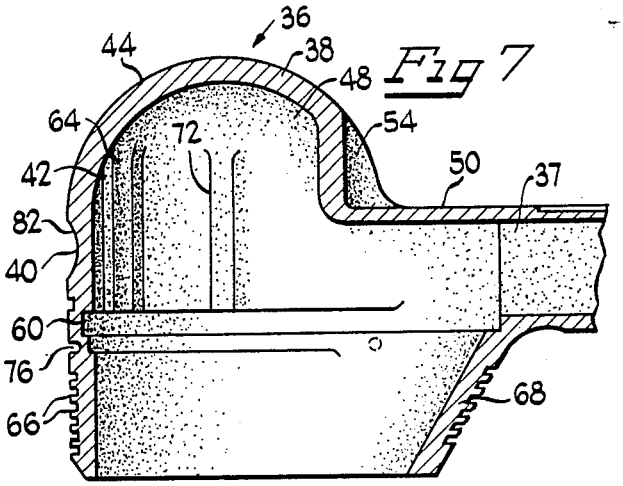
FIG. 7 is a fragmentary sectional view of the cover taken along the line 7—7 of FIG. 4.
Figure 6:
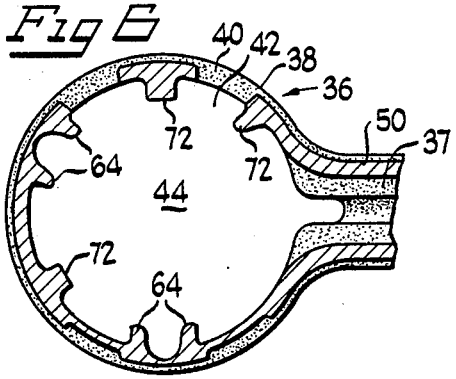
FIG. 6 is a fragmentary sectional view taken along the line 6—6 of 3.
Figure 8:
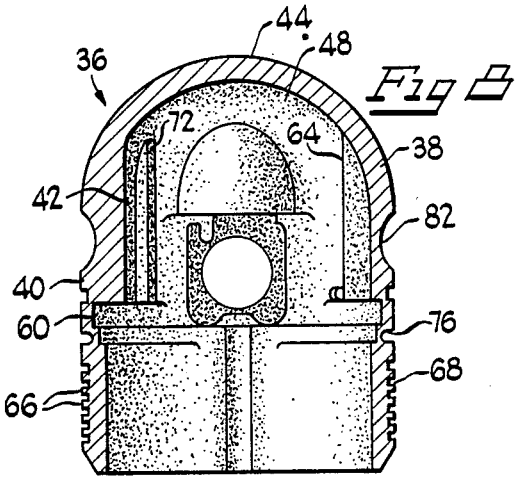
FIG. 8 is a sectional view taken along the line 8—8 of FIG. 4.
Figure 9:
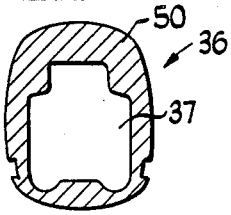
FIG. 9 is a sectional view taken along the line 9—9 of FIG. 4.
Figure 11:
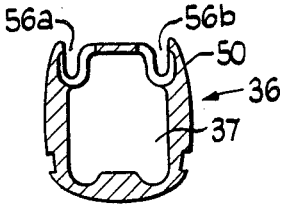
FIG. 11 is a sectional view taken along the line 11—11 of FIG. 4.
Figure 13:
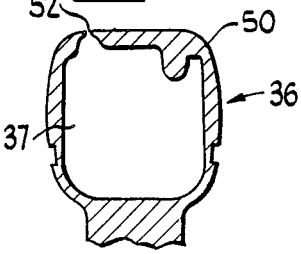
FIG. 13 is a fragmentary sectional view taken along the line 13—13 of FIG. 4.
Figure 10:
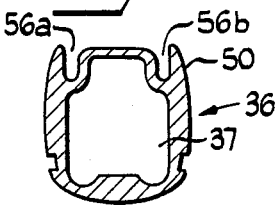
FIG. 10 is a sectional view taken along the line 10—10 of FIG. 4.
Figure 12:
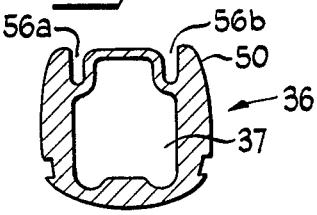
FIG. 12 is a sectional view taken along the line 12—12 of FIG. 4.

With reference to FIGS. 1–13, the cover 36 has a slot 52 (FIGS. 1, 2, 4, and 13) to slidably receive the lever 34 which is utilized to regulate the range of air flow, and the first body portion 38 has a rear recess 54 (FIGS. 1, 2, 3, 4, and 7) to receive the lever 34 at one end of its travel in the slot 52, with the recess 54 providing a space to receive the user's thumb for control of the lever 34. The second body portion 50 has a pair of elongated grooves 56*a* and 56*b* (FIGS. 1, 2, 4, and 10–12) to receive associated flanges 57 on the paddle 28 when it is depressed toward the handle 22 of the tool 20. The cover 36 also has an aperture 58 (FIGS. 3 and 4) to receive the pin 32. The first body portion 38 has a groove 60 (FIGS. 3, 7, and 8) to receive a peripheral ledge 62 (FIGS. 1 and 3) of the motor 24 in order to retain the cover in place on the motor 24. The motor 24 has a pair of spaced outwardly directed retaining members 70 (FIG. 1) extending upwardly from the ledge 62, and the first body portion 38 has a pair of associated, correspondingly spaced, inwardly directed flanges 64 (FIGS. 5–8) to receive the retaining members 70 in order to retain the cover 36 in place on the motor 24. The first body portion 38 has a plurality of additional inwardly directed flanges 72 (FIGS. 5 and 6), and the lower ends of the flanges 64 and 72 bear against the ledge 62 and prevent movement of the cover 36 in the event that the user pushes down on the dome 44 of the cover 36. The first body portion 38 has a pair of elongated slots 74 (FIG. 2) on opposed sides of the first body portion 38 to permit the exhaust of air through the slots 74 of the cover 36. The first body portion 38 has a groove 76 (FIGS. 1–3, 7, and 8) extending peripherally around a lower portion 68 of the first body portion 38 to receive a resilient locking ring 78 (FIG. 3) which is expanded and snap-fit into the groove 76, such that the ring 78 urges the underlying part of the cover 36 into snug engagement beneath an enlarged portion 80 (FIG. 3) of the ledge 62 in order to prevent slippage of the first body portion 38 upwardly from the motor 24. The first body portion 38 has an outer peripheral recess 82 (FIGS. 1–3, 7, and 8) to receive the user's fingers in a portion spaced from the exhaust slots 74, and permit the application of leverage by the user's fingers in the recess 82 in order to press down on the tool 20. The first body portion 38 has a plurality of fins 66 (FIGS. 3, 7, and 8) extending around the lower portion 68 of the first body portion 38, with the lower portion 68 covering rotating parts 90 associated with the motor 24 to protect the user's fingers. When assembled, the cover 36 is permanently mounted on the motor 24 and the handle 22.

In accordance with the present invention, the cover 36 is of a soft, resilient material to provide a comfortable grip and insulate the hands of the user from vibration and cold exhaust air during use of the tool 20. The dome 44 and chamber 48 act as a muffler to reduce noise, and the cover 36 protects the motor 24 and handle 22 if dropped and dampens vibration of the tool 20 during use. Further, the cover 36 shields rotating parts of the motor 24 from the user to prevent injury during use of the tool 20, and the injection molded cover 36 provides an aesthetically pleasing appearance without the necessity of cosmetic operation such as polishing and painting which are eliminated from the cover 36 of the present invention.

While there has been described what at present is considered to be the preferred embodiment of the present invention, it will be apparent to those skilled in the art that various modifications and alterations may be made herein without departing from the true spirit and scope of the invention. It is intended that all variations and modifications are to be covered in the claims appended hereto.

I claim:

1. A cover for use with a motor and handle extending from the motor and composed of a soft, resilient, fairly rigid, thermoplastic elastomeric material of one-piece construction, said cover comprising a first body portion including a sidewall and a dome extending from said sidewall and defining a cavity to receive said motor, said dome being spaced from said motor to define a chamber between said dome and motor which serves as a muffler to reduce noise, and a hollow second body portion extending from said first body portion and having a bore to receive said handle, said cover providing a comfortable grip and insulating the hands of a user during use, said cover protecting said motor and handle from damage if dropped, damping vibration of said motor and handle, and sufficiently shielding said motor to prevent injury to said user, said cover having an external surface which is aesthetically pleasing without additional cosmetic operations to said external surface.

2. The cover of claim 1, being composed of rubber.

3. The cover of claim 2, being injection molded.

4. The cover of claim 1, wherein said dome has a convex shape.

5. A tool, comprising:

a motor;

a handle extending from said motor; and a cover including a first body portion having a sidewall and a dome extending from said sidewall defining a cavity to receive said motor, and a hollow second body portion extending from said first body portion and having a bore to receive said handle, said cover providing a comfortable grip and insulating the hands of a user during use, said cover protecting said motor and handle from damage if dropped, damping vibration of said motor and handle, and sufficiently shielding said motor to prevent injury to said user, said cover having an external surface which is aesthetically pleasing without additional cosmetic operations to said external surface.

6. The tool of claim 5, wherein said handle has a lever pivotally mounted on the handle, and in which said second body portion includes an elongated sot to receive said lever.

7. The tool of claim 6, wherein said first body portion includes a rear recess to receive said lever at a forward position of said lever in said slot.

8. The tool of claim 5, wherein said handle includes a valve pin, and in which said second body portion includes an aperture to receive the valve pin.

9. The tool of claim 5, and further comprising a paddle pivotally mounted to said handle and having a pair of elongated spaced flanges, said second body portion including a pair of elongated spaced grooves to receive said flanges.

10. The tool of claim 5, wherein said dome is spaced from said motor and defines a chamber between said dome and motor.

11. The tool of claim 10, wherein said dome has a convex shape.

12. The tool of claim 5, wherein said motor includes a peripheral ledge, said first body portion including an inner peripheral groove to receive said ledge.

13. The tool of claim 5, wherein said first body portion includes a plurality of peripheral fins adjacent a lower portion of said first body portion.

14. The tool of claim 5, wherein said motor is driven by a fluid, said first body portion including opening means positioned to pass exhaust of fluid from said motor.

15. The tool of claim 14, wherein said opening means is a plurality of slots.

16. The tool of claim 5, wherein said motor includes lower rotating parts, said first body portion including a lower portion covering said rotating parts.

17. The tool of claim 5, wherein said first body portion includes a peripheral recess to receive the fingers of a user.

18. The tool of claim 17, wherein said motor is driven by a fluid, said cover further including at least one opening to permit exhaust of fluid from said motor, said recess being spaced from said opening.

19. The tool of claim 5, wherein said motor includes a peripheral ledge having an upper enlarged portion in which said first body portion includes an inner peripheral groove to receive said ledge, and an outer peripheral groove positioned slightly below said enlarged portion, and further comprising a resilient locking ring in said peripheral groove to urge said cover beneath said enlarged portion and prevent slippage of said cover relative to the motor.

20. The tool of claim 5, wherein said motor includes a peripheral ledge, said first body portion including a plurality of spaced inwardly directed flanges located above said motor and having lower ends engaging against said ledge.

21. The tool of claim 5, wherein said motor includes at least one outwardly directed retaining member, said first body portion including a pair of spaced inwardly directed flanges to receive said retaining member.

22. The tool of claim 21, wherein said motor includes an outwardly directed peripheral ledge, said cover including an inner peripheral groove to receive said ledge, said retaining member extending upwardly from said ledge.

23. The tool of claim 22, wherein said flanges have a lower end engaging against said ledge.

24. The tool of claim 22, wherein said first body portion includes at least one additional inwardly directed flange having a lower end engaging against said ledge.

* * * * *